United States Patent [19]

Mori et al.

[11] Patent Number: 4,615,376

[45] Date of Patent: Oct. 7, 1986

[54] METHOD AND DEVICE FOR ELECTROMAGNETICALLY REGULATING POURING RATE IN CONTINUOUS CASTING

[75] Inventors: Takasuke Mori; Kenzo Ayata; Takahiko Fujimoto, all of Hyogo, Japan

[73] Assignee: Kabushiki Kaisha Kobe Seiko Sho, Kobe, Japan

[21] Appl. No.: 715,830

[22] Filed: Mar. 25, 1985

[30] Foreign Application Priority Data

Mar. 26, 1984 [JP] Japan ..... 59-43818[U]

[51] Int. Cl.[4] ..... B22D 27/02

[52] U.S. Cl. ..... 164/466; 164/502; 164/488; 164/437; 164/453

[58] Field of Search ..... 164/502, 466, 453, 449, 164/488, 437, 155, 4.1; 137/13, 808, 810; 222/591

[56] References Cited

FOREIGN PATENT DOCUMENTS 770650 10/1980 U.S.S.R. ..... 164/502

*Primary Examiner*—Kuang Y. Lin

*Attorney, Agent, or Firm*—Oblon, Fisher, Spivak, McClelland & Maier

[57] ABSTRACT

A device for electromagnetically regulating the pouring rate in continuous casting, including a cylindrical molten steel container having a molten steel inlet formed in a peripheral section of an upper surface thereof and a molten steel outlet formed in central section of a lower surface thereof to pour the molten steel into a mold, and electromagnetic coils disposed around the side wall of the molten steel container so as to generate a rotating magnetic field perpendicularly to the side wall. The pouring rate is determined by the interactive function of the head of the molten steel in the tundish disposed above the molten steel container with the outlet thereof joined to the inlet of the molten steel container, the intensity of the rotating magnetic field, namely, the magnitude of the electric current supplied to the electromagnetic coils, and the size of the molten steel outlet, namely, a replaceable pouring nozzle.

5 Claims, 10 Drawing Figures

METHOD AND DEVICE FOR ELECTROMAGNETICALLY REGULATING POURING RATE IN CONTINUOUS CASTING

BACKGROUND OF THE INVENTION (1) Field of the Invention

The present invention relates to a method and a device for pouring a molten metal from a tundish into a mold in a continuous casting process, and more specifically to a method and a device for electromagnetically controlling the molten metal pouring rate in pouring a molten metal from a tundish into a mold in the continuous casting process.

(2) Description of the Prior Art

In the continuous casting of steel, the molten steel is supplied from a ladle into and stored temporarily in a tundish, and then the molten steel is poured into a mold from the tundish at a steady flow, to carry out continuous casting at a fixed casting rate. According to a conventional procedure of pouring the molten steel from the tundish into the mold, the molten steel pouring rate is regulated through the regulation of the level of the molten steel in the tundish when a tundish having a pouring nozzle of a small diameter is used, or through the regulation of the effective nozzle area by means of a stopper or a slide valve when a tundish having a pouring nozzle of a large nozzle area is used.

The former regulating method, however, is liable to cause the pouring nozzle of the tundish to clog, when the pouring temperature is low or in casting a steel with high aluminum content. Particularly, in casting billets of a small cross sectional area on a continuous casting machine, in which the molten steel needs to be poured at a low pouring rate, the molten steel needs to be maintained at a high temperature, which unavoidably entails the deterioration of the internal quality of the billet due to central segregation or cavities. Furthermore, this regulating method is incapable of being applied to manufacturing fine-grained steels with high aluminum content, because the pouring nozzle is clogged with alumina.

On the other hand, the latter regulating method employing a stopper for regulating the pouring rate is incapable of regulating the pouring rate satisfactorily, because only a slight change in the stroke of the stopper affects greatly the variation of the flow rate of the molten steel. While employment of a slide valve facilitates flow rate regulation, the slide valve is liable to result in air being sucked through the clearance between the sliding surfaces. The air thus sucked causes oxidation of the molten steel and increases the impurity content of the castings.

In consideration of the disadvantages of the conventional methods and devices, electromagnetic pumping devices for pouring a molten steel into a mold for continuous casting have been invented.

Molten steel pouring devices employing an electromagnetic driving mechanism of a linear motor type are described, for example, in "Technische Forschung Stahl", F. R. Block, 1980, and "Recherche Techniqueacier, 1980.

The electromagnetic driving mechanism of a linear motor type published in the former reference will be described hereinafter in connection with FIGS. 1 to 3. A tundish 1 is mounted on a portable table 2 so as to be tiltable on a support 3 (the tundish 1 is tilted by a hydraulic cylinder 4 to a position 1*a* indicated by alternate long and short dash lines after pouring). A ladle 5 is disposed over the tundish 1 to supply molten steel 6 to the tundish 1.

The tundish 1 has a refractory vessel 7 provided with a lid 8 and a supply trough 10 for pouring the molten steel 6 supplied from the ladle 5 into the tundish 1 into a mold 9.

The supply trough 10 extends diagonally upward from the refractory vessel 7 so that the highest position in the molten steel passage formed in the supply trough 10 is located above the level of the surface of the molten steel 6. The molten steel is driven by electromagnetic driving units 11 and 12 so as to flow over the highest position in the molten steel passage through an outlet 13 and into the mold 9. A reference numeral 14 designates a casting radius. The electromagnetic driving unit 11 is secured to the underside of the supply trough, while the other electromagnetic driving unit 12 is disposed movably on the topside of the supply trough 10.

FIG. 2(*a*) is a sectional view of the supply trough 10 and the lower electromagnetic driving unit 11, and FIG. 2(*b*) is a sectional view taken on line A—A in FIG. 2(*a*).

The molten steel passage 21 of a width 2*a* is formed in the supply trough 10. Coils 22 each wound around an iron core 23 are provided in the upper section of the electromagnetic driving unit 11. Although not shown in the drawings, plural sets each including a coil 22 and an iron core 23 are arranged longitudinally.

FIG. 3 is a sectional perspective view showing the lateral half of the electromagnetic driving unit 11 broken along the longitudinal centerline thereof and the molten steel 24 being transported. FIG. 3 further shows diagrammatically the respective values of a magnetic induction B and a current density i at a moment. A three-phase AC current is supplied to the coils 22. The three phases are arranged so that the pole pitch $\tau$ (half of the length of the period of variation of magnetic flux density) corresponds to three coils 22. Thus, the vectors $\vec{B}$ and $\vec{i}$ are produced, and thereby the molten steel is transported electromagnetically along the longitudinal direction of the supply trough 10 on the same principle as that of the well known linear motor.

The above-mentioned conventional electromagnetic molten steel supply trough incorporating a linear motor electromagnetic driving device has the following disadvantages. The inherent characteristics of the linear motor electromagnetic driving device require a long molten steel supply passage, which is liable to cause the temperature of the molten steel to drop while the molten steel is transported through the long supply trough. Furthermore, this conformation of the linear motor device has difficulty in producing a magnetic line of force which penetrates through the molten steel in the trough. Therefore, the inside diameter of the trough needs to be small for smooth transportation of the molten steel, and a large inside diameter increases the magnitude of the power required for molten steel transportation remarkably. Still further, the last portion of the residual molten steel needs to be discharged from the tundish by tilting the tundish, which requires a tilting mechanism.

SUMMARY OF THE INVENTION

Accordingly, the objects of the present invention are to provide a novel method and device for electromagnetically regulating the pouring rate in continuous casting, capable of obviating the clogging of the pouring nozzle and readily regulating the powering rate.

These and other objects are achieved according to the invention by providing a novel method and device for electromagnetically regulating the pouring rate in continuous casting, wherein a molten steel container having a molten steel inlet formed in a peripheral section of an upper surface thereof is provided to receive a molten steel supplied from a tundish. A molten steel outlet is formed in a central section of the lower surface of the container to pour the molten steel therethrough into a mold. Electromagnetic coils are disposed around the side wall of the molten steel container so as to generate a rotating magnetic field extending perpendicularly to the side wall.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2(*b*) is a cross sectional view taken along line A—A in FIG. 2(*a*);

DESCRIPTION OF THE PREFERRED EMBODIMENTS

Figure 1:
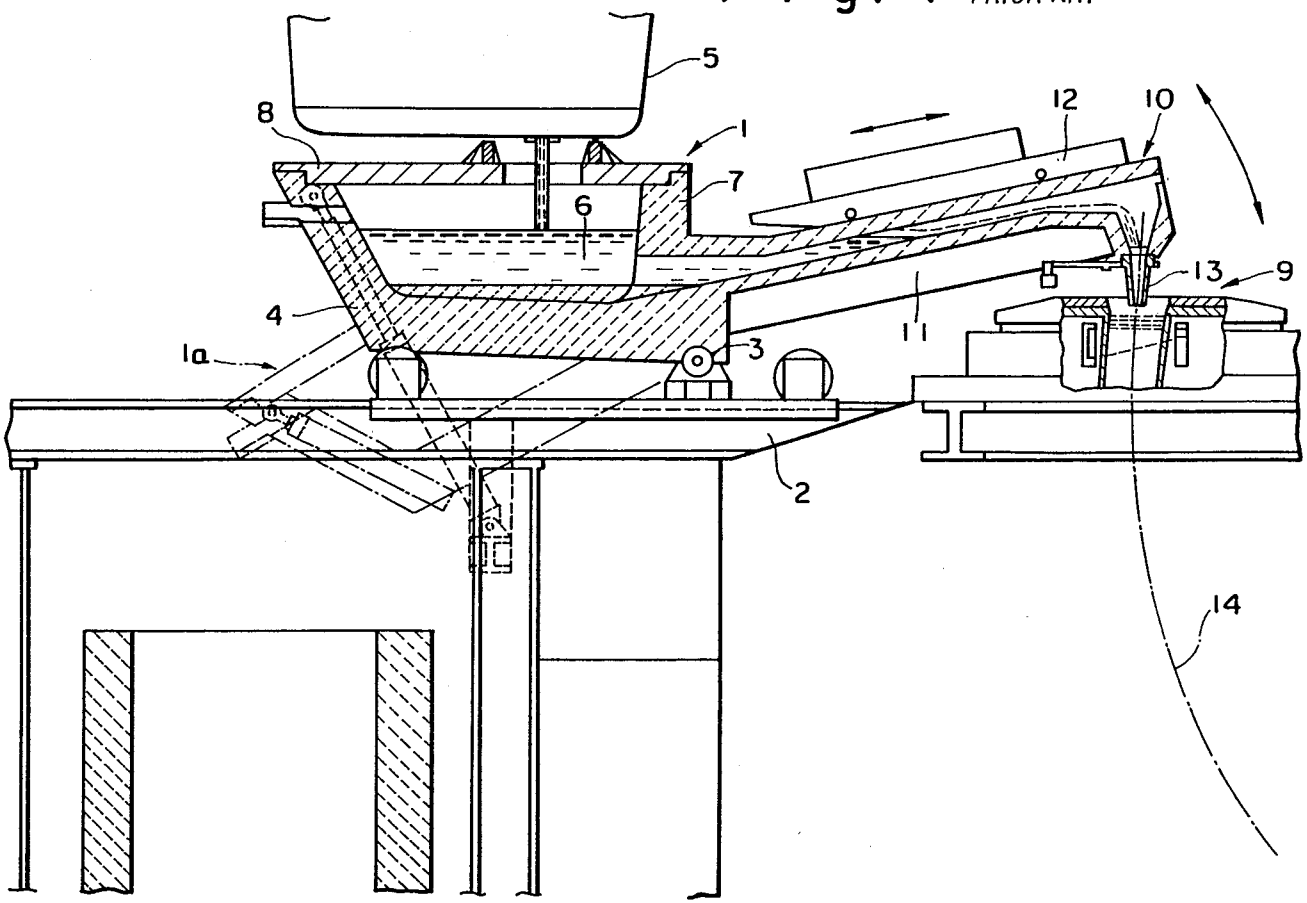
Fig. 1 PRIOR ART
FIG. 1 is a fragmentary cross sectional view showing the manner of pouring a molten steel through a tundish equipped with an electomagnetic supply trough of a linear motor type.
Figure 2A:
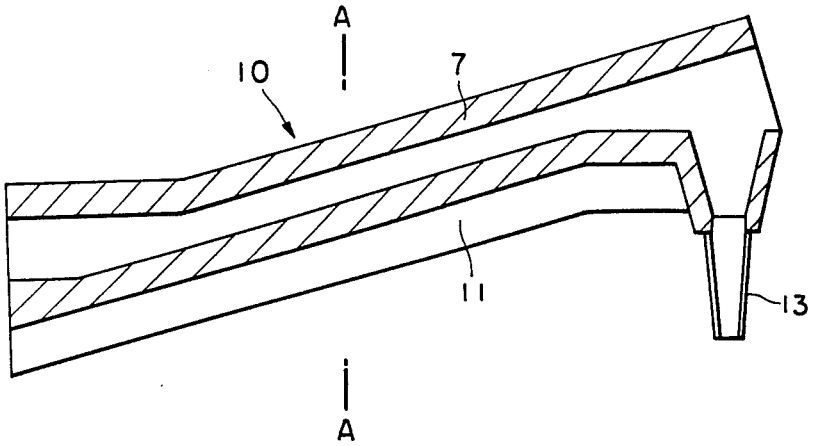
Fig. 2(a) PRIOR ART
FIG. 2(*a*) is a cross sectional view of an electromagnetic supply trough.
Figure 2B:
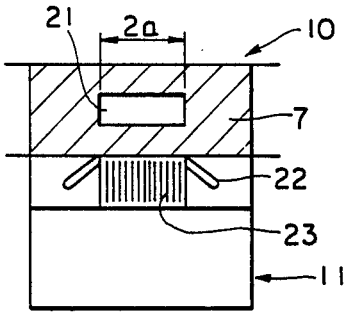
Fig. 2(b) PRIOR ART
Figure 3:
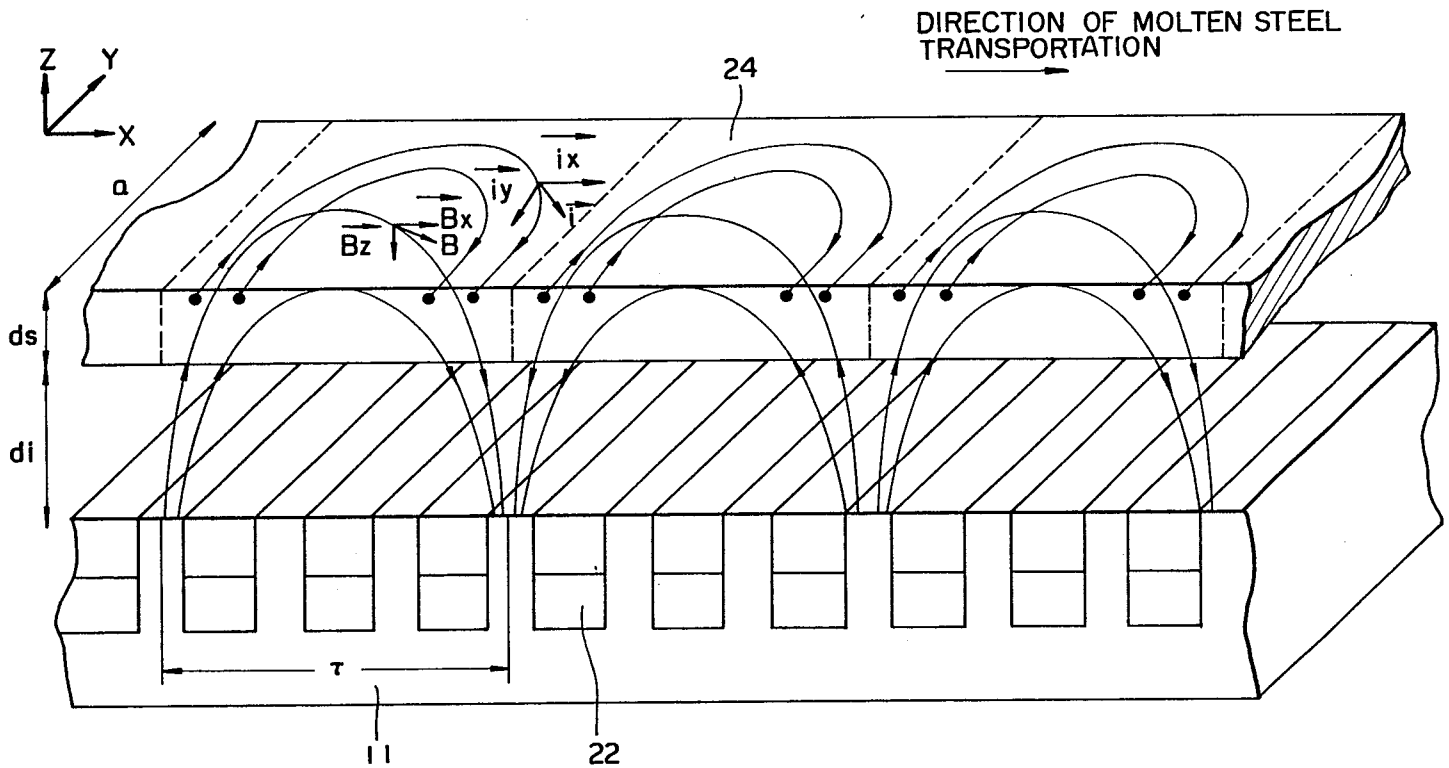
Fig. 3 PRIOR ART
FIG. 3 is a cross sectional perspective view showing an electromagnetic driving unit, a molten steel under transportation, and the respective values at a moment of the magnetic induction $\vec{B}$ and the current density $\vec{i}$.
Figure 4:
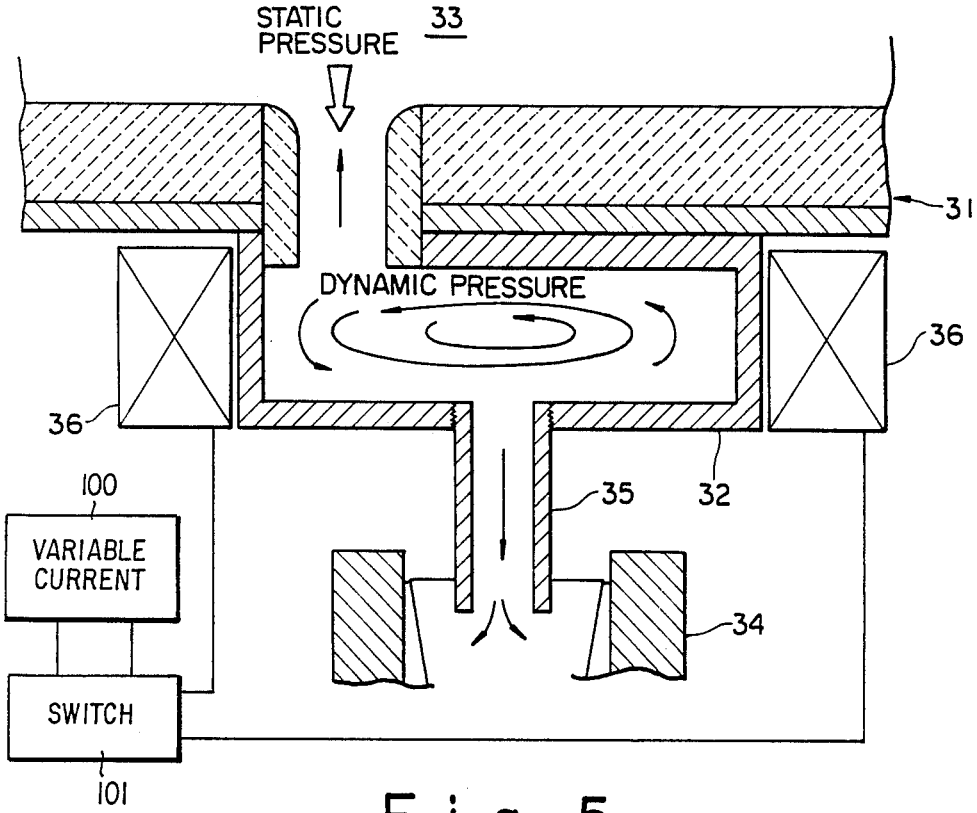
FIG. 4 is a schematic cross sectional view of a device for electromagnetically regulating the pouring rate in continuous casting, according to the present invention.

Referring now to the drawings, wherein like reference numerals designate identical or corresponding parts throughout the several views, FIG. 4 shows the general configuration of a device for electromagnetically regulating the pouring rate in continuous casting, according to the present invention.

Figure 5:
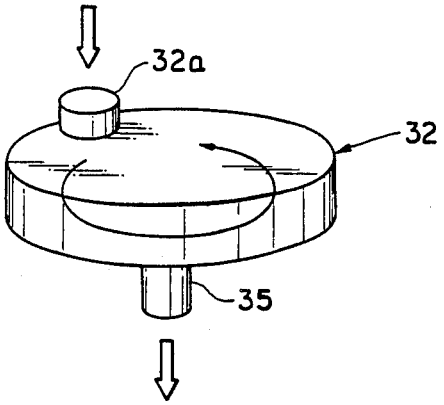
FIG. 5 is a perspective view of a refractory container.

A refractory container 32 is joined to the underside of a tundish 31 below the molten steel outlet of the tundish 31. As shown in the perspective view of FIG. 5, the refractory container 32 has the form of a short cylinder, and is provided with an inlet 32*a* formed in the peripheral section of the topside thereof to receive molten steel 33 therethrough and a pouring nozzle 35 attached to the under side in a central section thereof to pour the molten steel 33 therethrough into a mold 34. Electromagnetic coils 36 are arranged around the refractory container 32 and are connected to an AC power source so as to generate a rotating magnetic field. This embodiment comprises the refractory container 32 and the electromagnetic coils 36 of rotating magnetic field connection.

Supplying an AC current to the electromagnetic coils 36 for continuous casting causes the molten steel contained in the refractory container 32 to swirl in the refractory container 32. The dynamic pressure produced by a centrifugal force due to the swirling motion of the molten steel 33 and acting on the molten steel 33 in the peripheral section of the refractory container 32 counteracts the static pressure dependent on the level of the surface of the molten steel 33 in the tundish 31, so that the pressure that acts on the molten steel in the peripheral section of the refractory container 32 is reduced. On the other hand, the swirling flow speed of the molten steel in the central section of the refractory container 32 within a horizontal plane is practically zero, hence the dynamic pressure is practically zero. Accordingly, the pressure that acts on the molten steel in the central section of the refractory container 32 is smaller than the static pressure decided by the level of the surface of the molten steel in the tundish 31 by a pressure corresponding to the dynamic pressure counteracting the static pressure in the peripheral section of the refractory container 32, and thereby the pouring rate is reduced accordingly. The effect of the dynamic pressure on the reduction of the pouring rate is equivalent to that of the level of the surface of the molten steel in the tundish 31 on the reduction of the pouring rate. Thus, the pouring rate can be adjusted to a desired value by controlling the centrifugal force of the molten steel through the regulation of the magnitude of the current supplied to the electromagnetic coils 36 by way of the variable current generator 100. Furthermore, the pouring rate can be held at a fixed value by varying the magnitude of the AC current supplied to the electromagnetic coils according to the variation of the level of the surface of the molten steel in the tundish.

As apparent from the principle of pouring rate regulation above described the device for electromagnetically controlling the molten metal pouring rate according to the present invention is able to employ a pouring nozzle of a large size, since the apparent level of the molten metal in the tundish is reduced, and allows the tundish to be disposed nearer to the mold as compared with a molten metal pouring device of a linear motor type.

The device of the present invention is the same as the conventional electromagnetic molten metal supply trough in respect of the employment of electromagnetic force for transporting the molten steel, however, the device of the present invention further has a new pouring rate regulating mechanism which regulates the pouring rate by the dynamic pressure resulting from the centrifugal force that acts on the molten steel.

Figure 6:
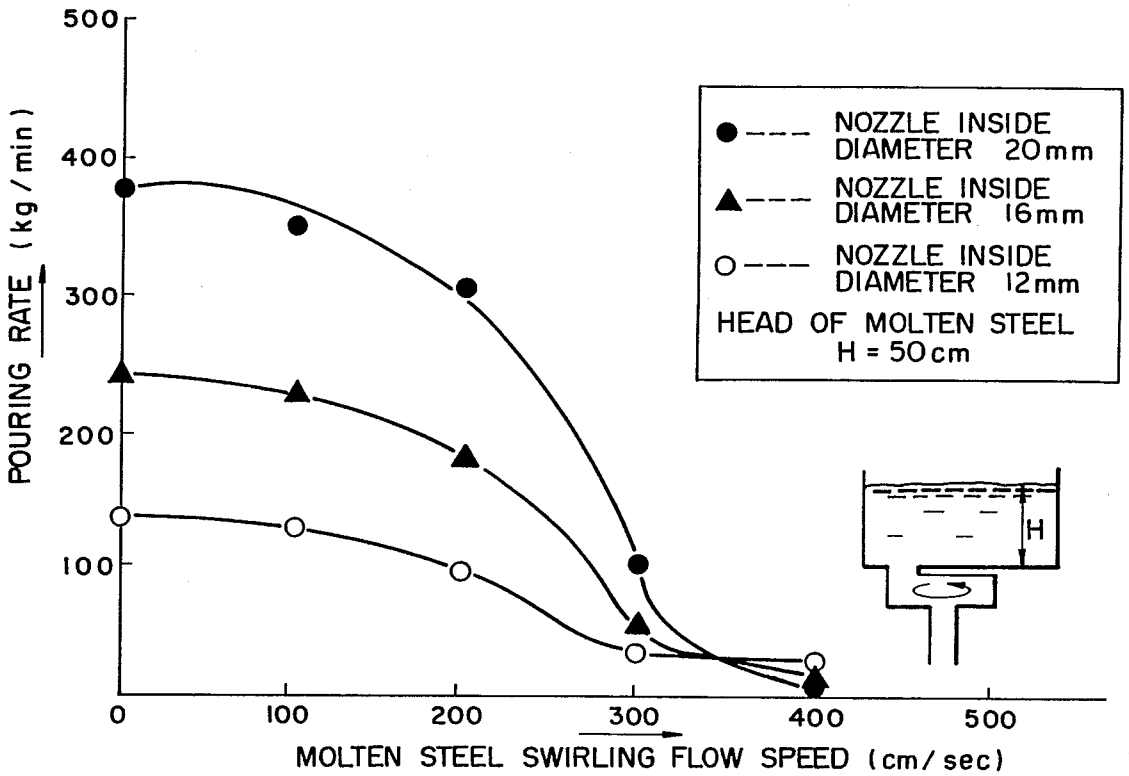
FIG. 6 is a graph showing the relation of the flow rate of the molten steel flowing through the pouring nozzle to the revolving rate of the molten steel in the refractory container.

Experiments were carried out to examine the pouring rate regulating charcteristics of the device for electromagnetically regulating the pouring rate of the present invention. A molten steel (SS41) superheated by 50° C. was supplied into the tundish 31 so that the head of the molten steel held at 50 cm. The flow rate in weight of the molten steel that flowed out through the pouring nozzle 35 which is detachable was measured with a load cell for various magnitudes of the current supplied to the coils 36 and pouring nozzles 35 of various inside diameter. The measurements for pouring nozzles of 12 mm, 16 mm and 20 mm inside diameter are shown in FIG. 6. The swirling flow speed of the molten steel was estimated from the results of separate experiments with a low melting point metal.

As apparent from FIG. 6, the flow rate decreases with the increase in the swirling flow speed, and the device is capable of controlling the flow rate over a wide range.

However, the flow rate remains almost unchanged regardless of the swirling flow speed after the swirling flow speed has exceeded 300 cm/sec, because the dynamic pressure in the central portion of the swirling flow of the molten steel in the refractory container changes scarcely and is not affected by the swirling flow of the molten steel, and hence the flow of the molten steel through the pouring nozzle cannot perfectly be restricted. Accordingly, the device has a minimum controllable flow rate $Q_{min}$ (kg/min).

Figure 7:
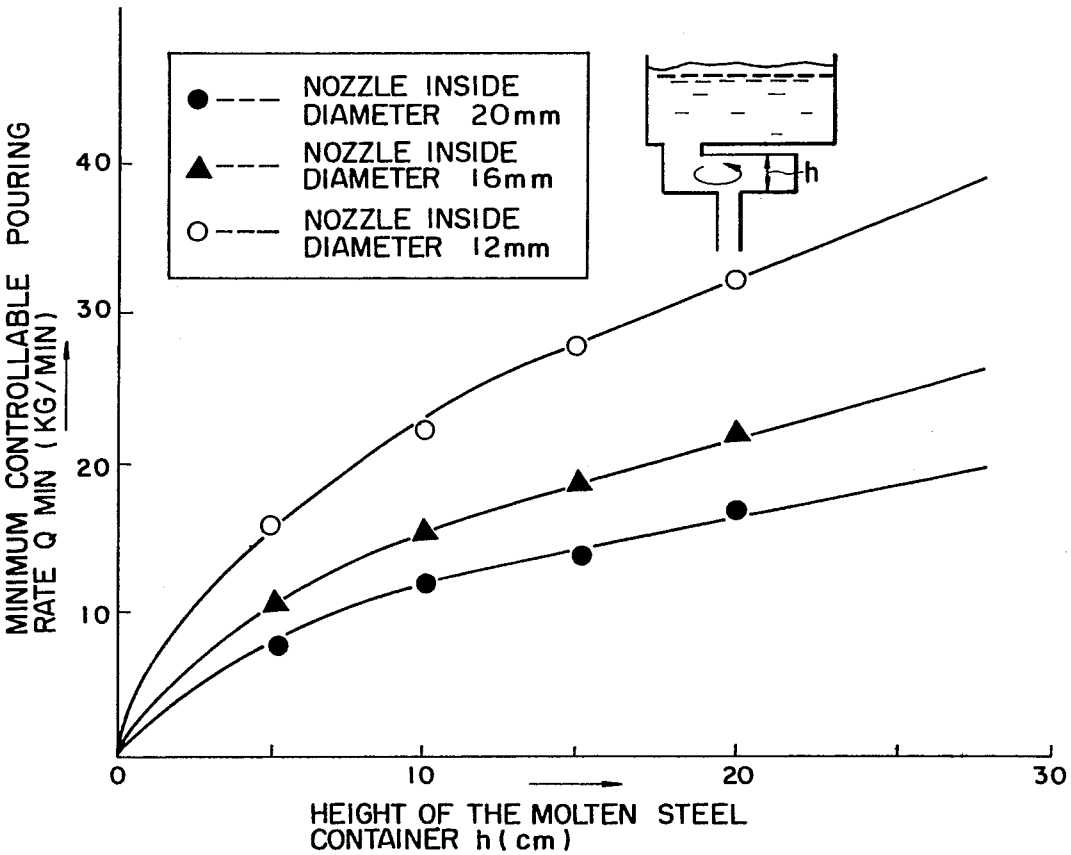
FIG. 7 is a graph showing the relation of the controllable minimum pouring rate to the height of the refractory container.

As apparent from FIG. 7, it was found that $Q_{min}$ is dependent on the mozzle diameter d (mm) and the head h (cm) of the molten steel in the refractory container, and that $Q_{min}$ is expressed as a function of d and h by the following expression:

$$Q_{min}=(4.03\times10^{-2}\cdot d^2-1.74d+22.19)\sqrt{h}.$$

From this expression, it is known that $Q_{min}$ decreases with the increase of d and increases with the increase of h.

The nozzle diameter d is determined by the maximum pouring rate for the molten steel to be poured, therefore, h needs to be reduced to diminish $Q_{min}$. However, the magnetic flux density of the coils needs to be increased to maintain the swirling flow speed of the molten steel unchanged when h is reduced, hence, the magnitude of the current supplied to the coils needs to be increased, which affects the molten steel swirling efficiency adversely. Accordingly, the head h of the molten steel in the refractory container is decided in consideration of both the pouring rate control range and the molten steel swirling efficiency.

Figure 8:
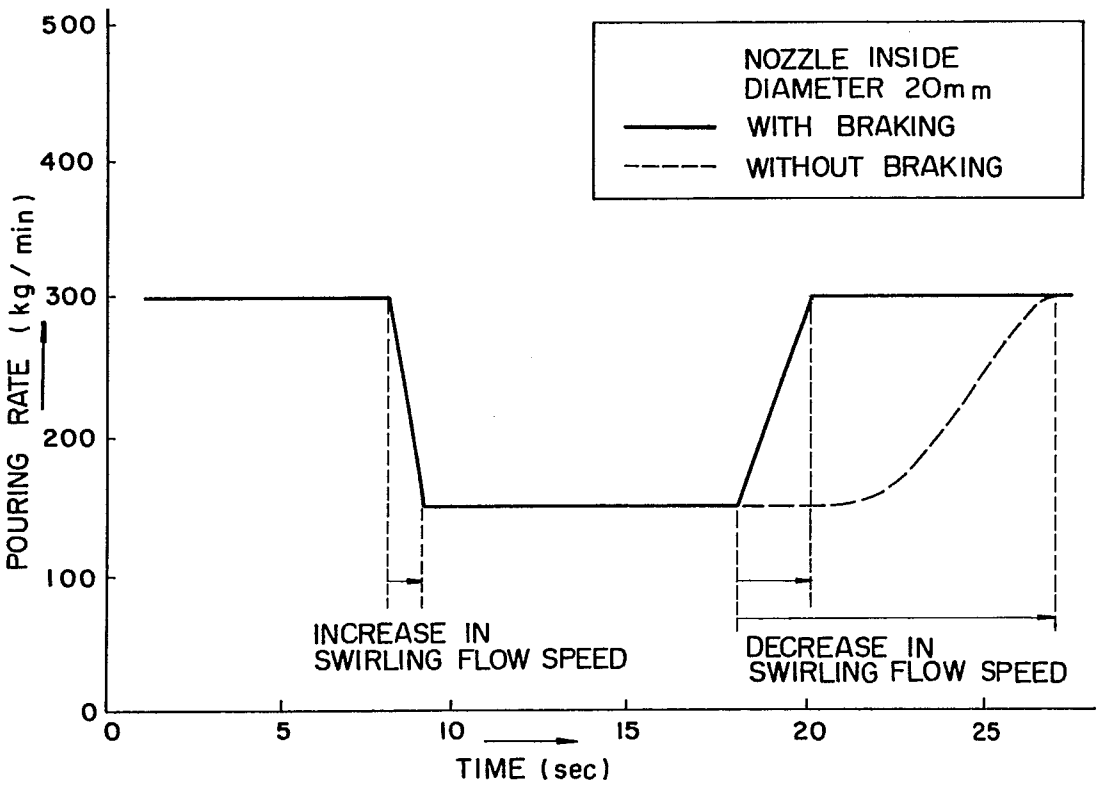
FIG. 8 is a graph showing the pouring rate controlling characteristics of the device of the present invention.

FIG. 8 shows the variation of the molten steel pouring rate with time for a pouring nozzle of 20 mm diameter. The increase of the swirling flow speed of the molten steel in the refractory container, namely, the decrease of the pouring rate, is achieved in a short time of approximately 1 sec, whereas the decrease of the swirling speed, namely, the increase of the pouring rate, takes as long a time as 9 sec due to the inertial flow of the molten steel, as indicated by broken line in FIG. 8. Such an increasing rate is too low to be practiced. It was found that this problem could be solved by the following method. In case the swirling flow speed needs to be decreased, a braking force is applied to the swirling molten steel for about 1 sec, by switching the direction of the current flow by way of switch 101 in FIG. 4 and then the magnitude of the current supplied to the coils is adjusted to a magnitude corresponding to the swirling flow speed in the normal direction. It was found that the application of this method enabled the pouring rate regulation to be achieved within approximately 2 sec in increasing the pouring rate.

Figure 9:
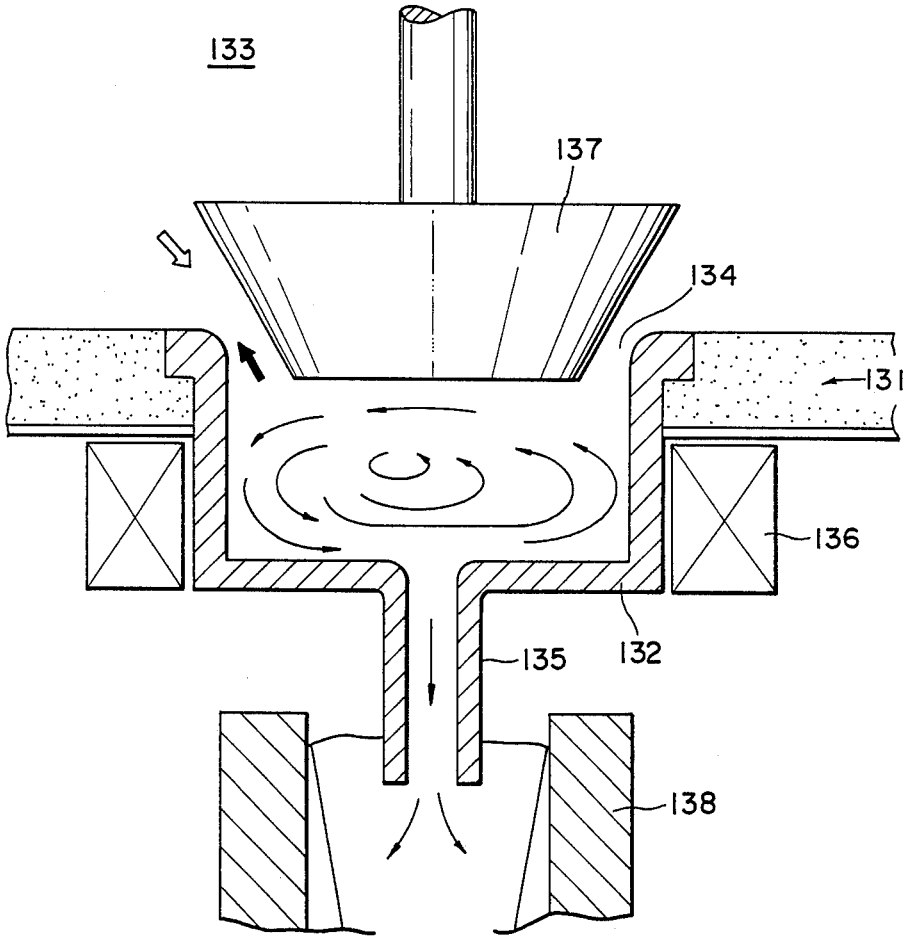
FIG. 9 is a schematic cross sectional view of a variation of a device for electromagnetically regulating the pouring rate in continuous casting, according to the present invention.

FIG. 9 shows another embodiment of the device according to the invention. A refractory container 132 is joined to the underside of tundish 131 below the molten steel outlet of the tundish 131. The refractory container 132 has the form of a short cylinder and a stopper of large diameter 137 is disposed at the center of the refractory container 132. Before teeming, the stopper is closed and the container 132 is not filled with molten steel. When the teeming is started, the stopper is lifted and the molten steel fills the container 132 through a gap 134 between the refractory container 132 and the stopper 137. The molten steel is teemed into a mold 138 through a pouring nozzle 135 attached to the under side in the center section of the refractory container 132.

Around the container 132, electromagnetic coils 136 are arranged and are connected to AC power source so as to generate a rotating magnetic field. In the refractory container 132, a dynamic pressure produced by the centrifugal force due to the swirling motion of molten steel 133 and acting on the molten steel 133 through the gap 134 counteracts the static pressure dependent on the level of the surface of the molten steel 133 in the tundish 131, so that the pressure that acts on the molten steel at the gap 134 is reduced. Thus the pouring rate is reduced in the same way as that described above.

By providing the stopper 137, the operation of teeming becomes easier, because the teeming can be started after the tundish 131 is filled with the molten steel and the meniscus level in the tundish reaches to a fixed value and the teeming can be stopped easily by closing the stopper.

The device for regulating the pouring rate in continuous casting, according to the present invention is thus constructed and functioned on the above-mentioned principle, which enables the use of a pouring nozzle of a large diameter, and hence the pouring nozzle clogs rarely.

Furthermore, the device does not employ any mechanism having sliding surfaces, such as a slide valve. Therefore, air will not be sucked through clearances between sliding surfaces, which further facilitates the regulation of the pouring rate as compared with a stopper.

Still further, the employment of electromagnetic coils arranged so as to generate a rotating magnetic field eliminates a long trough which is necessary in a molten metal pouring device of a linear motor type, so that the distance between the tundish and the mold can be reduced. Particularly, in pouring a molten steel, the temperature of which is liable to drop quickly, the distance between the tundish and the mold needs to be reduced to the shortest possible distance, in which the device of the present invention is particularly effective.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for electromagnetically regulating a pouring rate of molten steel supplied from a tundish in continuous casting, comprising:

a cylindrical molten steel container having a molten steel inlet formed in a peripheral section of an upper surface thereof to receive molten steel supplied from the tundish therethrough and a molten steel outlet formed in a central section of a lower surface thereof to pour the molten steel therethrough into a mold, and electromagnetic coils disposed around the side wall of the molten steel container so as to generate a rotating magnetic field extending perpendicularly to the side wall.

2. A device for electomagnetically regulating the pouring rate in continuous casting, according to claim 1, wherein said molten steel outlet comprises a pouring nozzle detachably attachable to the molten steel container.

3. A device for electromagnetically regulating the pouring rate in continuous casting, according to claim 1, comprising:

means for adjusting the intensity of the rotating magnetic field.

4. A method for electromagnetically regulating the pouring rate in continuous casting, employing a cylindrical molten steel container having a molten steel inlet formed in a peripheral section of an upper surface thereof to receive a molten steel supplied from a tundish through the inlet therethrough and a molten steel outlet formed in a central section of a lower surface of the container to pour the molten steel through the outlet into a mold, and electromagnetic coils disposed around the side wall of the molten steel container so as to generate a rotating magnetic field extending perpendicularly to the side wall, comprising:

joining the molten steel inlet tightly to the outlet of the tundish disposed above the molten steel container, mounting the molten steel container with a pouring nozzle of a size meeting predetermined casting conditions, deciding the magnitude of an electric current to be supplied to the electrogmagnetic coils according to the size of a pouring nozzle provided on said outlet, regulating the magnitude of the electric current according to the variation of the head of the molten steel in the tundish, and connecting the electrogmagnetic coils to a current source so that a rotating magnetic field is generated.

5. A method for electromagnetically regulating the pouring rate in continuous casting, according to claim 4, comprising:

reversing the direction of rotation of the rotating magnetic field in increasing the pouring rate, thereby to brake the swirling movement of the molten steel in the molten steel container.

* * * * *